US007100633B2

(12) United States Patent
Lechuga

(10) Patent No.: US 7,100,633 B2
(45) Date of Patent: Sep. 5, 2006

(54) UNITARY PIPE COVER ASSEMBLY FOR UNDERSINK PIPES

(76) Inventor: Gabriel Lechuga, 7 Cambridge Rd., Rancho Mirage, CA (US) 92234

( * ) Notice: Subject to any disclaimer, the term of this patent is extended or adjusted under 35 U.S.C. 154(b) by 429 days.

(21) Appl. No.: 10/361,193

(22) Filed: Feb. 6, 2003

(65) Prior Publication Data

US 2004/0154662 A1 Aug. 12, 2004

Related U.S. Application Data

(63) Continuation-in-part of application No. 09/735,342, filed on Dec. 12, 2000.

(60) Provisional application No. 60/405,572, filed on Aug. 23, 2002, provisional application No. 60/355,067, filed on Feb. 7, 2002.

(51) Int. Cl.
*F16L 7/00* (2006.01)
*F16L 9/22* (2006.01)

(52) U.S. Cl. ..... 137/375; 138/155; 138/158; 285/47

(58) Field of Classification Search ..... 137/375; 138/155, 158; 285/47
See application file for complete search history.

(56) References Cited

U.S. PATENT DOCUMENTS 3,153,546 A * 10/1964 Dunn ..... 285/13
5,303,730 A * 4/1994 Trueb et al. ..... 137/375
5,360,031 A * 11/1994 Trueb et al. ..... 137/375
5,454,392 A * 10/1995 Trueb et al. ..... 137/375
5,564,463 A * 10/1996 Helmsderfer ..... 137/375
5,586,568 A * 12/1996 Helmsderfer ..... 137/15.08
5,901,739 A * 5/1999 Helmsderfer ..... 137/375
5,915,412 A * 6/1999 Helmsderfer ..... 137/375
6,739,353 B1 * 5/2004 Lechuga ..... 137/375

* cited by examiner

*Primary Examiner*—A. Michael Chambers
(74) *Attorney, Agent, or Firm*—Robert J. Schaap

(57) ABSTRACT

A unitary protective pipe cover for disposition about a pipe configuration under a conventional sink, and which is sized and shaped so as to cover the J-trap, as well as the waste arm, in the undersink pipe configuration. In the event that the waste arm extends at an acute angle with respect to the J-trap, the pipe cover can be severed and the two severed pipe cover sections can be secured together in a generally tamper proof arrangement.

35 Claims, 10 Drawing Sheets

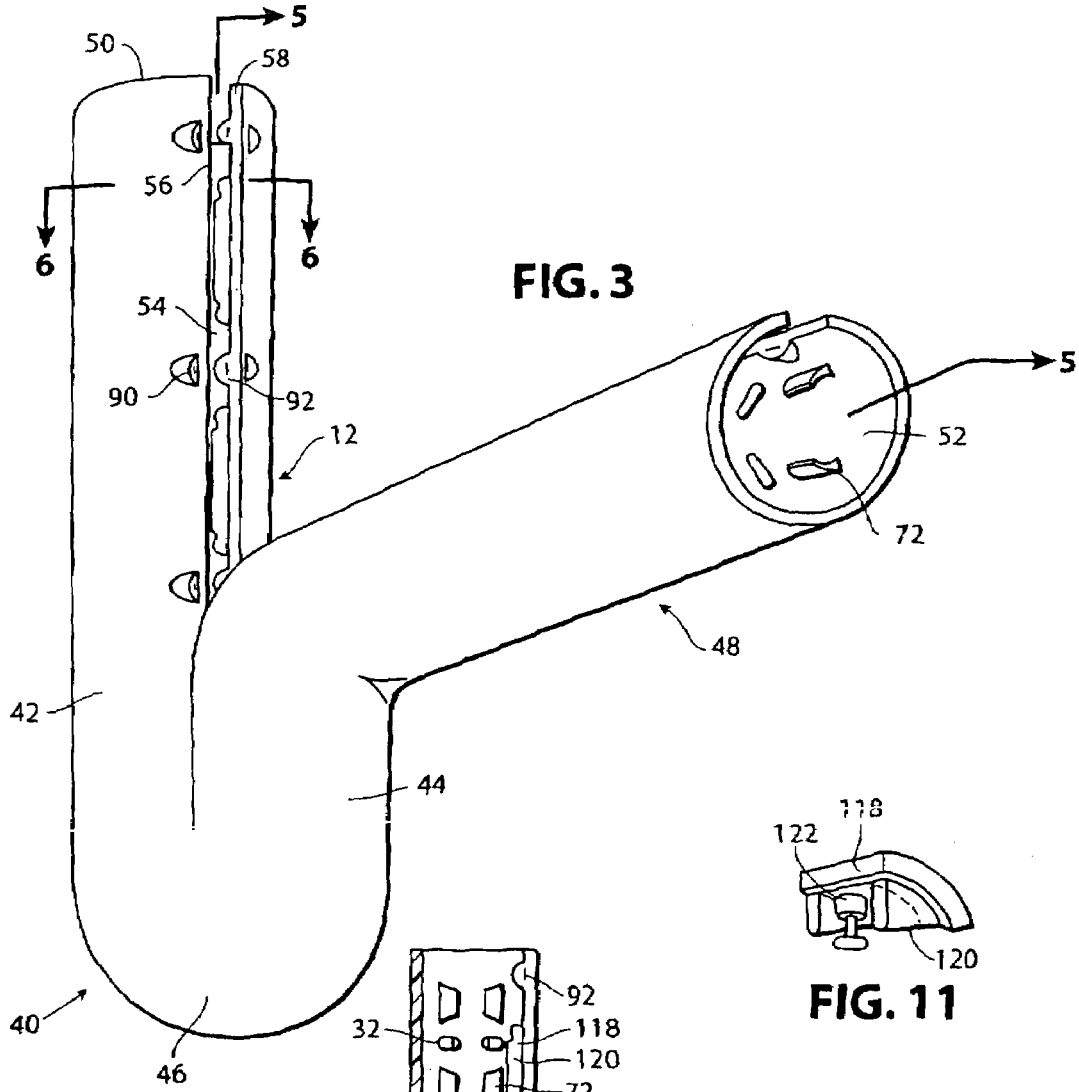
FIG. 3
FIG. 11
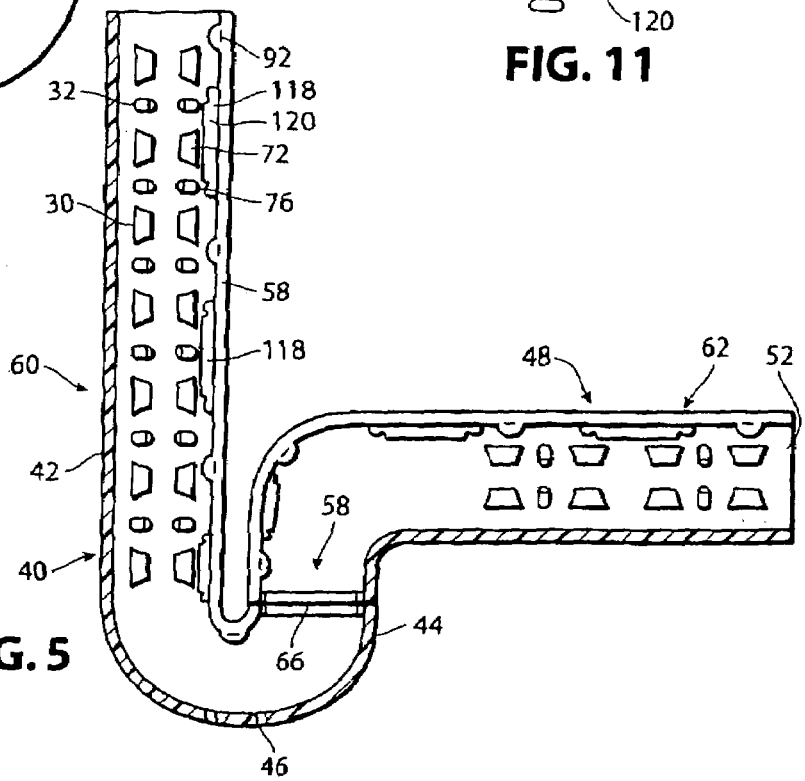
FIG. 5

UNITARY PIPE COVER ASSEMBLY FOR UNDERSINK PIPES

RELATED APPLICATIONS

This application is a continuation-in-part of my co-pending U.S. patent application Ser. No. 09/735,342 filed Dec. 12, 2000, for Heat Protective Cover System for Hot Water Pipes, and which is based on and claims priority from my U.S. Provisional Patent Application Ser. No. 60/355,067, filed Feb. 7, 2002 for One Piece Several Pipe Protective Cover, and is also based on and claims priorty from my U.S. Provisional Patent Application Ser. No. 60/405,572, filed Aug. 23, 2002, entitled Undersink Protective Cover.

BACKGROUND OF THE INVENTION

1. Field of the Invention

This invention relates in general to certain new and useful improvements in a pipe cover adapted for disposition around pipes under a sink in order to cover same, and more particularly, to a unitary jacket adapted to generally conform to the shape and size of the undersink pipe configuration, to thereby cover same, and where the jacket can be adapted to conform to the shape of the pipe configuration, in the event that the waste arm extends at an acute angle with respect to the J-trap of the undersink pipe configuration.

2. Brief Description of Related Art

In recent years, there has been an increased emphasis in covering undersink pipes, primarily, although not exclusively, to protect those individuals who are wheelchair bound, and who might otherwise roll their wheelchair to a partial undersink position. In this case, the knees and legs of the individual in the wheelchair might otherwise come into contact with a pipe forming part of a pipe configuration. If hot water should be passing through, or have recently passed through that pipe, the individual in the wheelchair would become burned. Moreover, the party in a wheelchair may be less able to extricate himself or herself from that situation as quickly as an ambulatory individual.

In addition to the foregoing, pipe configurations under a sink frequently contain edges, such as edges on pipe nuts and the like and exposed threads, which can actually be injurious to a person who comes into moderately hard contact with such portion of a pipe configuration.

Recently, and at least in the United States, the Americans With Disabilities Act has mandated protection on undersink pipes in certain public buildings, in order to reduce the incidence of this type of injury. As a result, many public buildings are required to have such protection on undersink pipe configurations. As a result, there has been a plethora of undersink protective covers for disposition around the undersink pipe components.

Generally, the undersink pipe configuration includes a J-trap, that is, a pipe section generally having a J-shape, with a pair of vertically arranged legs connected by a U-shaped section. There is also a waste arm which connects to a pipe, usually within a wall structure, and designed to carry waste water which passes through the J-trap and waste arm from the sink. In most cases, the waste arm generally lies in the same plane as the J-trap. However, depending upon the structure of the room involved, the waste arm can extend at an acute angle, with respect to the plane of the J-trap.

There have been several proposed protective jackets in the prior art which are provided in individual components, such as the J-trap cover and a waste arm cover. These covers are comprised of a heat insulative material designed to provide a degree of heat insulation by the jacket, in order to potentially reduce the incidence of burns and abrasive injuries. These jackets are comprised of a first jacket section having a generally J-shaped configuration, and a waste arm jacket having the shape of a waste arm, which is frequently in an L-shape. These jacket sections are designed to be located relative to one another so that they effectively cover the undersink pipe, which carries waste water from the sink to a drain pipe, generally located in a structure beyond the wall, as aforesaid.

Many of these commercially available protective covers for undersink pipe configurations were formed of injection molded plastics. They were longitudinally slit from end to end, so that the jacket could be spread apart and disposed about the pipe. However, the jacket essentially had to have the configuration of the section of pipe about which it was to be fitted. Each of these jackets or covers included pairs of apertures spaced along the longitudinal slit, and were sized to receive fastening means, and particularly, pin-type fasteners.

There are numerous U.S. patents representative of this type of device, and these include U.S. Pat. No. 5,303,730 to Trueb et al., and other related Trueb et al. patents. In this system proposed by Trueb et al., and although the jacket arrangement is initially provided as a unitary piece, it cannot be used in the fashion as shown, but must be separated so that it can properly fit upon an undersink pipe configuration. Also representative of fasteners used for securing edges of a jacket together along a longitudinal slit is the Du Laney U.S. Pat. No. 2,791,019, and the Guskea U.S. Pat. No. 3,914,100.

Another form of pipe cover arrangement is also shown in the Helmsderfer U.S. Pat. No. 5,915,412 and other related patents to Helmsderfer. The applicant of this application also has proposed a unitary pipe cover jacket which is normally formed of a fabric material, as opposed to an injection molded material, as for example, in U.S. Pat. No. 5,055,334 dated Oct. 8, 1991. However, this pipe cover, although being insulated, was not formed of an injection molded plastic material. As such, it did not spring back around the pipe itself when disposed about the pipe.

There were a number of problems with these prior art protective covers. First of all, they frequently did not fit properly. In many cases, the waste arm extended outwardly away from, and at an angle to, the plane of the J-trap. These prior art covers attempted to make some accommodation, but were not truly effective for that purpose. Secondly, and in the case of the covers disclosed in the Trueb et al. patents, they were frequently installed in an upside down position, and therefore, did not properly fit upon the pipe configuration. Thirdly, and with many of the previously described pipe covers, installers frequently complained about the difficulty in installing the covers. In addition, they were not necessarily vandal proof and could be removed from the pipe arrangement about which they were disposed.

In about the mid-1980s, there was an injection molded pipe cover which had a unitary structure, and which had a shape to fit over the J-trap and the P-trap of an undersink pipe configuration. In effect, this single cover which was also longitudinally slit from end to end, could be opened and resiliently extend back about the pipe configuration. When the waste arm was in the same plane as the J-trap, the pipe cover functioned quite well. However, in many cases, as aforesaid, the waste arm did not extend in the same plane as the J-trap. In those cases, there were attempts to make the pipe cover fit about the jacket because of its resiliency, but it did not properly fit, and in some cases, did not fully enclose the pipe about which it extended. Thus, if the waste arm extended angularly away from the J-trap beyond a relatively small angle, the jacket would not properly fit.

This unitary structure prior art cover or jacket, however, could have been separated in the region where the waste arm would be connected to the J-trap, so that it would form two pieces, essentially in the same manner as that shown in the Trueb et al. patents. However, it did not include suitable means for coupling the two pieces together after they were severed into two pieces from the unitary piece.

Notwithstanding the plethora of heat protective covers which have been offered in the marketplace, there has been a need for a protective cover for disposition around undersink protective pipes, which could be provided as a unitary piece, and severed if necessary, and coupled together about a pipe configuration in a generally tamper proof manner, and which was easy to install and highly efficient in operation.

OBJECTS OF THE INVENTION

It is, therefore, one of the primary objects of the present invention to provide a protective cover for disposition about and enclosing of a water pipe, and particularly, an undersink pipe with a unitary jacket capable of being fitted to a pipe configuration, having a waste arm which extends in the same plane of the J-trap of such pipe configuration, and where the waste arm may be located at an acute or sharply acute angle with respect to the plane of the J-trap.

It is another object of the present invention to provide a protective cover arrangement of the type stated, which includes a provision for separating one portion of the cover and which allows for a unique and highly efficient system of coupling the two separated sections together, when disposed about an undersink pipe configuration.

It is a further object of the present invention to provide a protective cover for an undersink pipe configuration of the type stated, which can be used on a wide variety of pipe arrangements, and for that matter, on a variety of different sized pipes.

It is an additional object of the present invention to provide an undersink protective pipe cover arrangement which can be rapidly and easily installed without the risk of installing the cover in an upside down position, or in another position for which the cover was not designed.

It is still a further object of the present invention to provide a protective cover for an undersink pipe configuration of the type stated, which is longitudinally slit over its length, and is provided with pairs of aligned apertures along the slit for receiving a highly effective fastener arrangement, which allows for securement of the jacket in a generally tamper proof manner.

It is also an object of the present invention to provide a protective cover arrangement for an undersink pipe configuration, which can be installed on the pipe configuration, and removed and thereafter reused on another undersink pipe configuration or on the same pipe configuration, without any destruction to the cover itself.

It is yet another object of the present invention to provide a protective cover for an undersink pipe configuration, in which the pipes forming part of that undersink pipe configuration are not necessarily of uniform construction, and which cover will still efficiently operate, and also comply with governmental code requirements.

It is also a further object of the present invention to provide a protective cover system for disposition about an undersink pipe configuration, which can be constructed at a relatively low cost, and which is highly efficient in installation and in use, and which complies with necessary governmental code requirements to protect individuals who may not be ambulatory.

It is still another object of the present invention to provide a protective cover system for an undersink pipe configuration, of the type stated, which are resilient, but yet fit properly about a pipe configuration, and which have a generally relatively constant outer diameter, but nevertheless, accommodate pipes of various cross-sectional sizes, and which also provide an aesthetically pleasing appearance.

With the above and other objects in view, my invention resides in the novel features of form, construction, arrangement and combination of parts and components presently described and pointed out in the claims.

BRIEF SUMMARY OF THE INVENTION

The present invention relates to an undersink protective pipe cover adapted to fit about a pipe configuration under a sink, and fully enclose same, to thereby protect against accidental contact with the pipe configuration. The cover, sometimes referred to as a "jacket", is formed of a moldable plastic material and may be produced in an injection molded operation or other molding operation. The protective cover of the invention preferably is provided as a unitary piece, having a shape comprised of a pair of generally vertically arranged legs, with one being a shorter leg than the other, and connected by a generally U-shaped section.

The pipe cover of the invention also has a right angled portion and a straight arm portion. The entire jacket is slit from end to end over its length. It can be spread apart and extend back about the pipe configuration. Since the entire cover or jacket may be formed of a somewhat resilient material, such as many well known injection molded plastics, it will automatically spring back about the pipe and generally cover the pipe. Rows of aligned apertures on opposite sides of the slit are provided for receiving locking pins, or the like.

In the arrangement as provided, the cover will fit about both the J-trap of the undersink pipe installation and the waste arm of the undersink pipe installation. In the vast majority of cases, the waste arm extends outwardly toward a waste water drain, usually within a wall structure leading to an underground drain line, and in the same plane as the J-trap. Also in the vast majority of cases, the waste arm may be angular with respect to the plane of the J-trap but does not deviate from that plane by any substantial degree. In such cases, and due to the resiliency of the material, the cover is capable of fitting about the J-trap and the waste arm merely by slightly bending the same. In addition, it can be easily, and either permanently or temporarily, secured in that fashion.

In cases where the waste arm extends outwardly from the plane of the J-trap and is located at an acute angle with respect thereto, the undersink protective pipe cover of the invention is adapted to be severed into a first piece which is sized and shaped to generally cover the J-trap, and a second piece which is generally sized and shaped to cover the waste arm. Moreover, there is a unique coupling mechanism, as hereinafter described, which allows for coupling of the J-trap and the waste arm, in such manner that no portion of the pipe between the ends of the cover is exposed, and so that the jacket can still remain on the pipe configuration in a relatively tamper proof manner.

The jacket of the invention preferably contains fins on the interior surface thereof. Although the fins may extend horizontally, they preferably extend in a generally vertical orientation over the length of the jacket. Thus, and in the case of the jacket which is normally circularly shaped in cross-section, the fins would be spaced apart from one another and extend for almost the full length of the jacket. This arrangement allows the fins to flex, in order to avoid protuberances on the pipe arrangement, and also allows the fins to snugly engage a nut, or like coupling element, and further aid in supporting the jacket or cover in a fixed position on the pipe. The fins further provide some spatial relationship between the pipe and the jacket, thereby further enhancing the insulative quality.

The individual pipe sections are all generally formed with a relatively constant diameter for a standard water pipe. Thus, the jackets of the invention are similarly provided with generally continuous cross-sectional shapes. Thus, when the jackets are fitted about the pipe arrangement, and if the jacket is severed into a pair of pieces, they fit together in an aesthetically pleasing manner.

The jacket of the invention provides a defined region for severing the jacket, if necessary, so as to provide a waste arm cover and a J-trap cover. Moreover, the jacket is readily severable in that defined region. In this way, if necessary, the installer can sever the jacket into two pieces. In the prior art, there were several proposals to provide an enlarged section at one end of one jacket section to receive the other jacket section, in a type of telescopic manner. Not only was that arrangement unsightly, but it did not function very well.

The present invention, therefore, provides a unique coupling ring arrangement for releasably locking the two pipe cover sections together as split, and for locking in abutting arrangement. However, this coupling ring construction also allows for a tight fitting abutment of one jacket section with respect to the other, and is essentially vandal proof.

In accordance with the coupling ring arrangement of the present invention, the coupling ring arrangement comprises an inner ring housing adapted to provide for holding the ends of the severed pipe sections, such as the J-trap cover and the waste arm cover, in abutting relationship. There is also provided an outer locking ring. Moreover, the two jacket sections are formed in the region of the severing of the two jackets, with inner grooves to receive and retentively lock with respect to the inner ring housing. Thus, for example, when the unitary jacket is severed in the severance region, as provided, the two pieces have essentially vertically arranged portions which are adapted to abut against one another. The vertical section of the J-trap cover is provided with an annular groove at its upper end, and in like manner, the vertical leg of the waste arm cover is similarly provided with an annular groove at its lower end.

The inner ring housing is provided with an outwardly struck flange sized to fit within the groove of the waste arm cover section, and the inner ring housing is similarly provided with a like ring to fit within the groove of the upper end of the J-trap cover section. In this way, the two cover sections can be releasably locked with respect to the groove of the inner coupling ring housing.

An outer coupling ring or "locking ring" is sized to extend about both of the jacket sections in the region where they abut, and is provided for locking engagement with the abutted J-trap section and the waste arm section. In this way, when completely assembled together, there is a very tight and secure connection between the two jacket sections.

Although the coupling ring has been shown to be used in connection with a waste arm section and a J-trap section, it should be understood that this coupling ring arrangement could be used for securing any two portions of jacket sections about a pipe, or for that matter, for securing separately formed jackets about a pipe. The coupling arrangement is highly effective for this purpose, and is easy to install.

As indicated previously, the jacket is formed with generally aligned pairs of apertures, and with one aperture of the pair on each side of the longitudinal slit. These apertures are more than mere openings. Integrally formed in the apertures are locking elements. These locking elements engage with locking pins provided for this purpose, thereby providing a relatively efficient and highly effective securement of the two portions of the jacket adjacent to the longitudinal slit.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention. However, it is to be understood that the following detailed description and the accompanying drawings are not to be taken in a limiting sense.

BRIEF DESCRIPTION OF THE DRAWINGS

Figure 1:
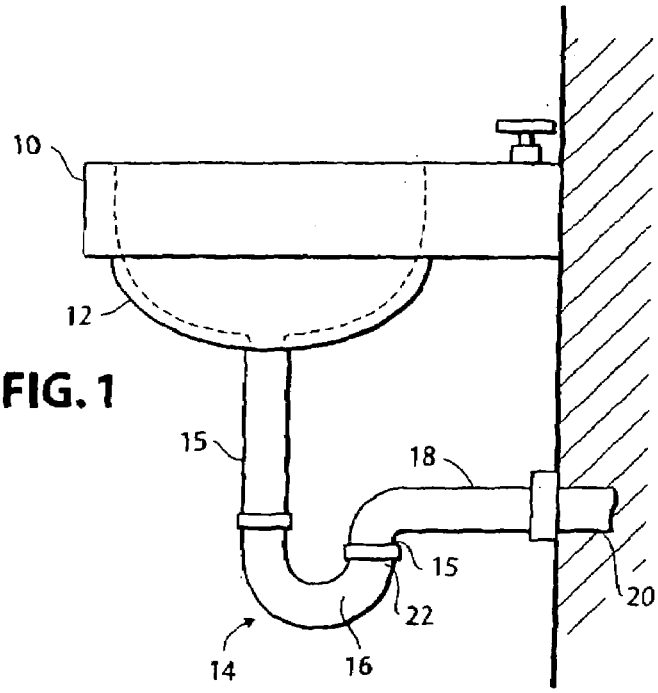
Figure 4:
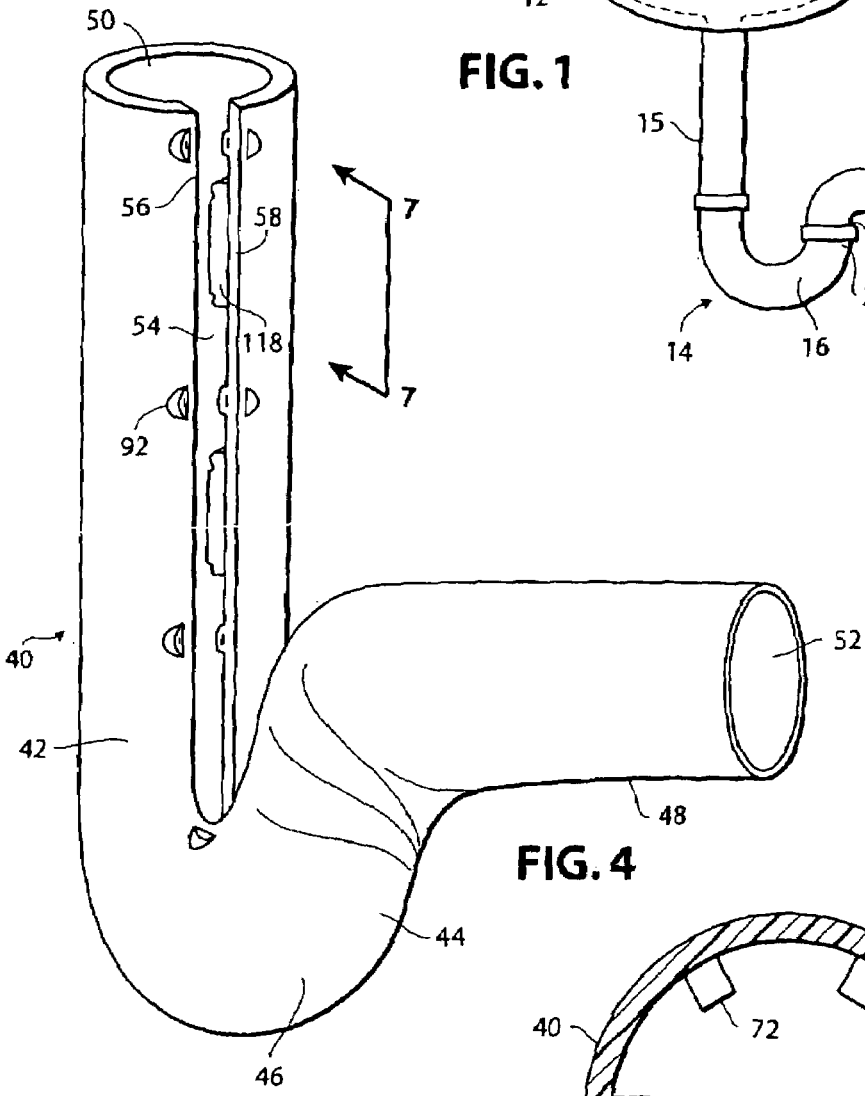
Figure 6:
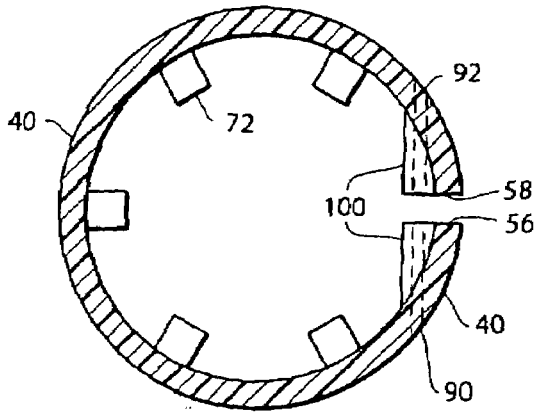
Figure 2:
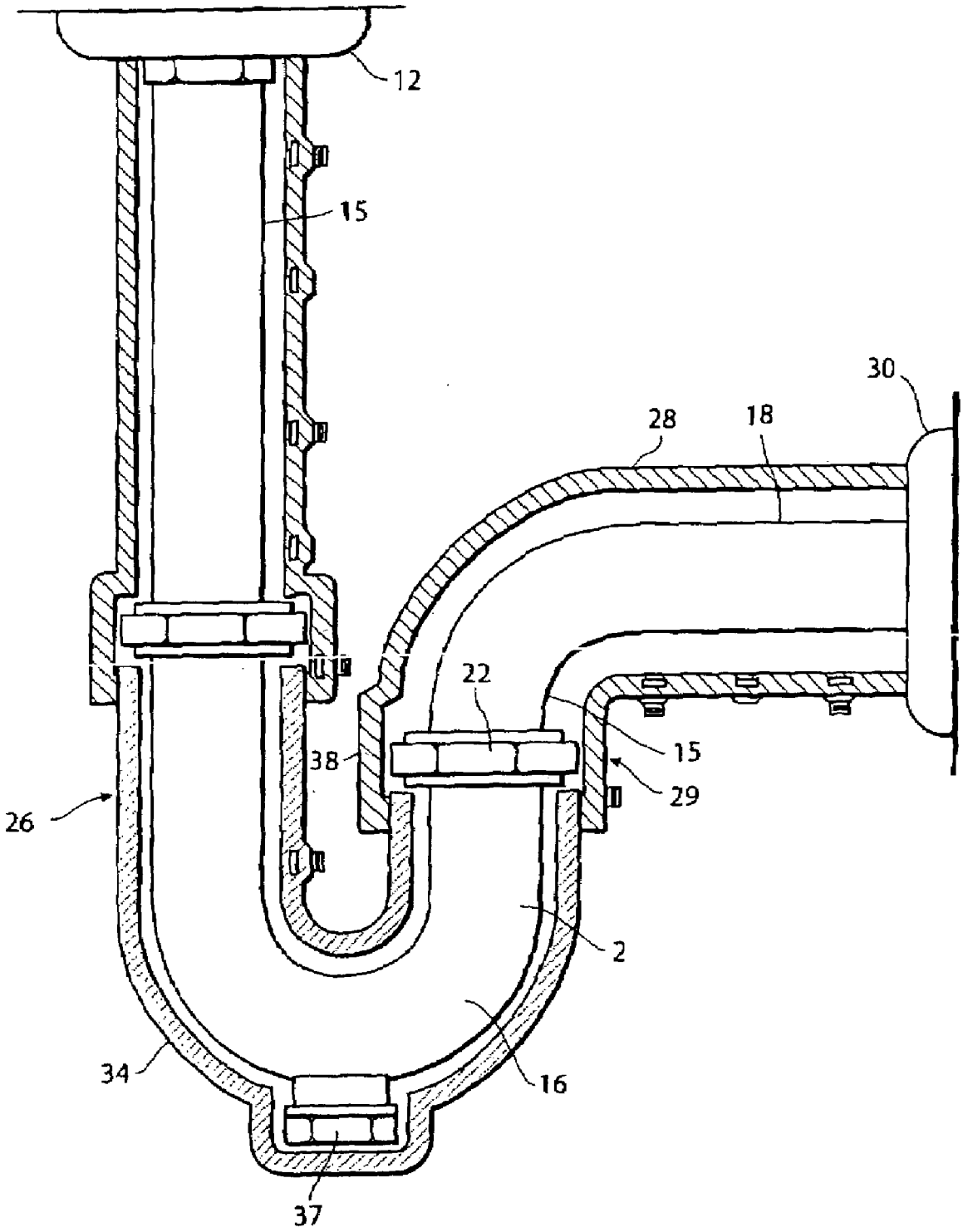
FIG. 2 (Prior Art)
Figure 5A:
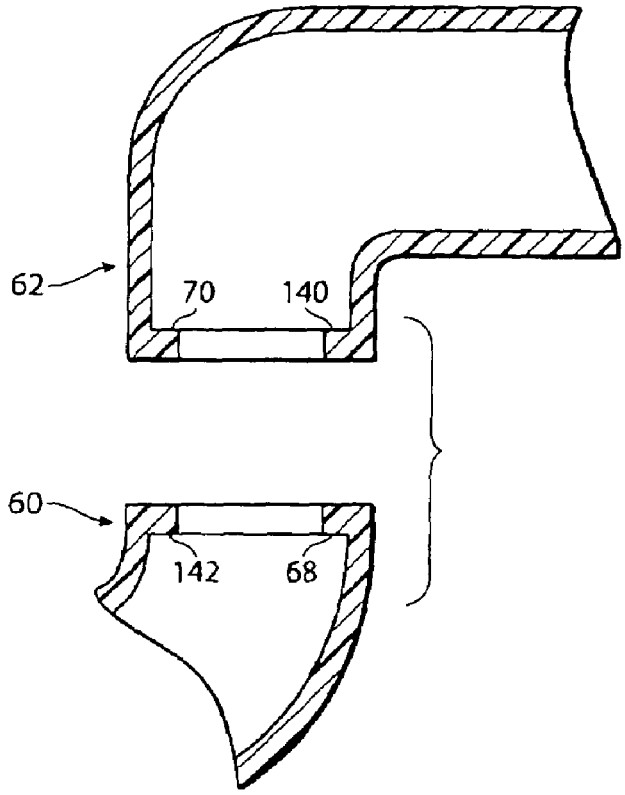
Figure 26A:
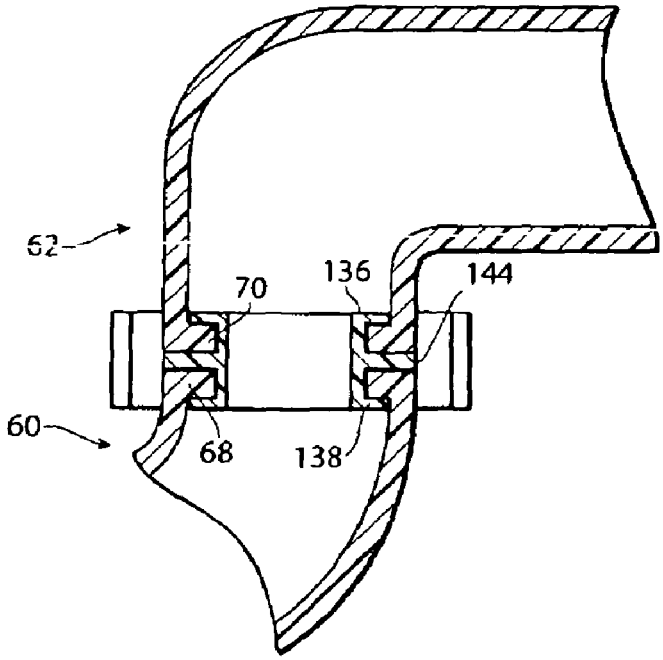
Figure 7:
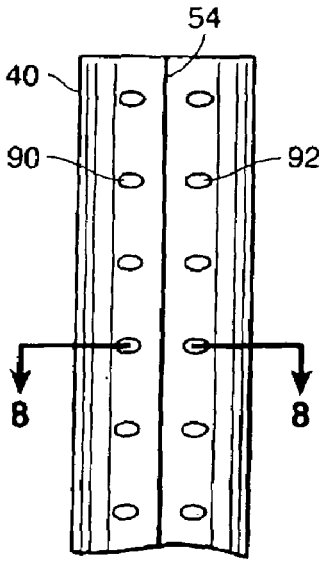
Figure 8:
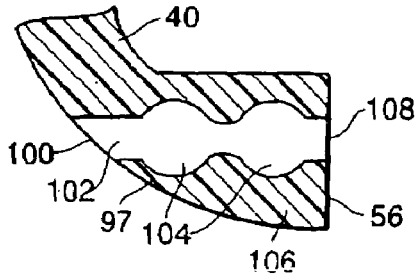
Figure 9:
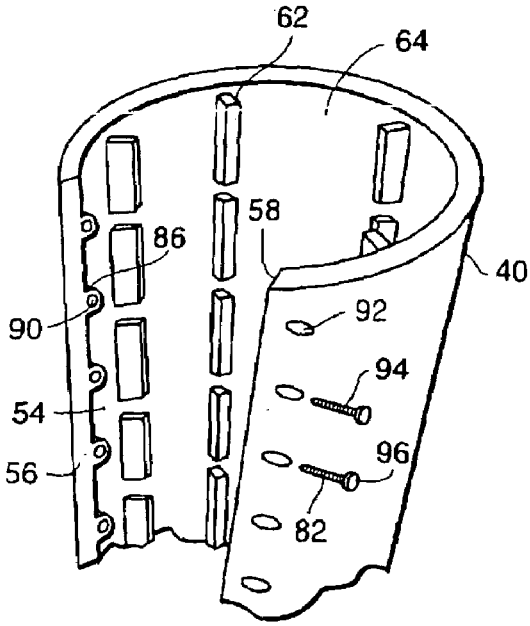
Figure 10:
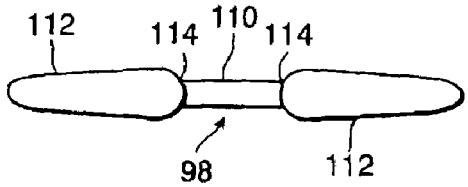
Figure 12:
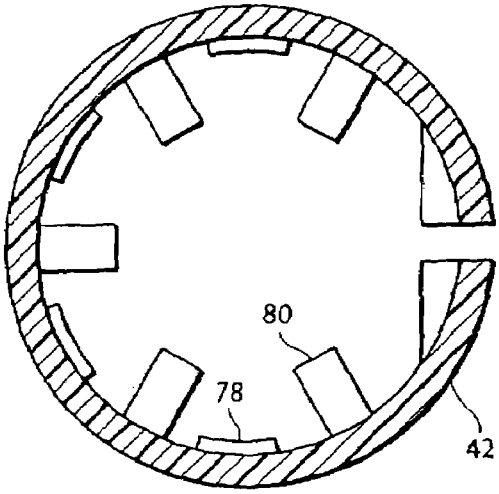
Figure 13:
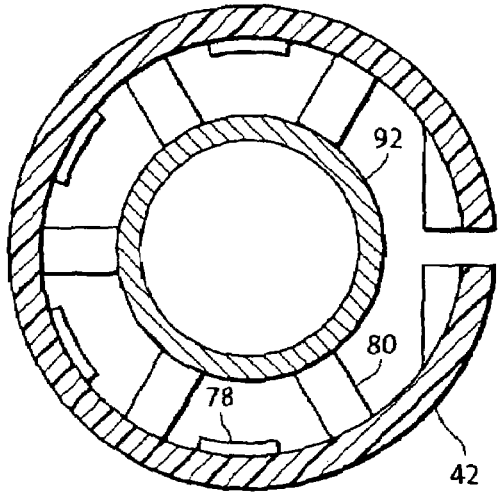
Figure 14:
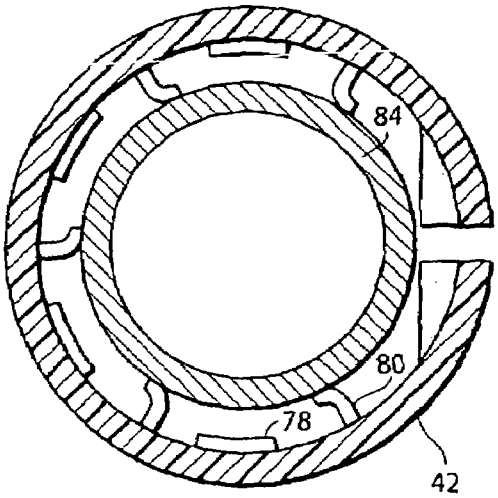
Figure 14A:
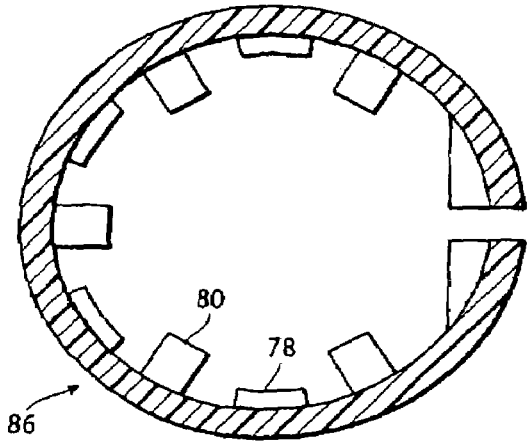
Figure 18:
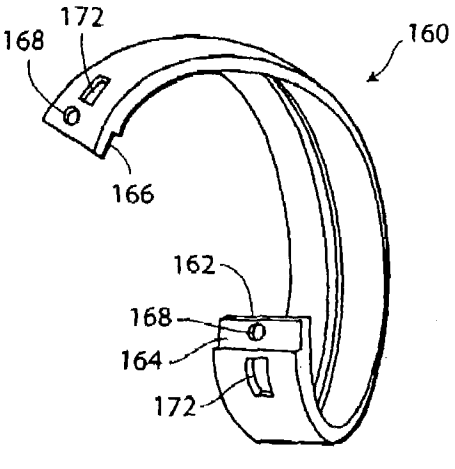
Figure 17:
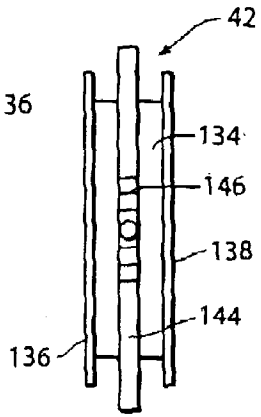
Figure 16:
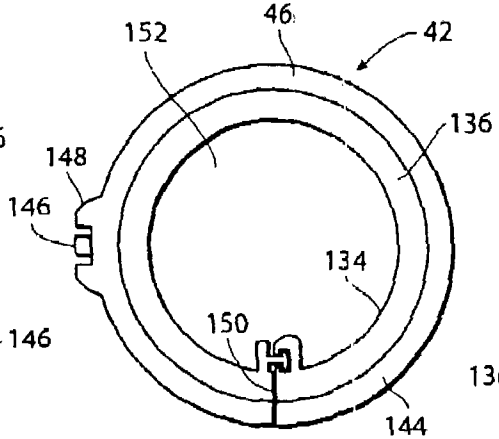
Figure 15:
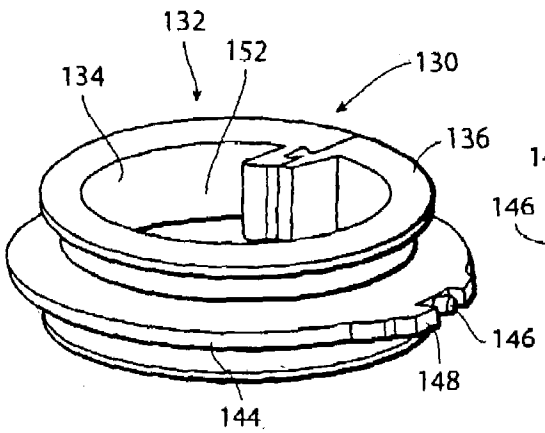
Figure 21:
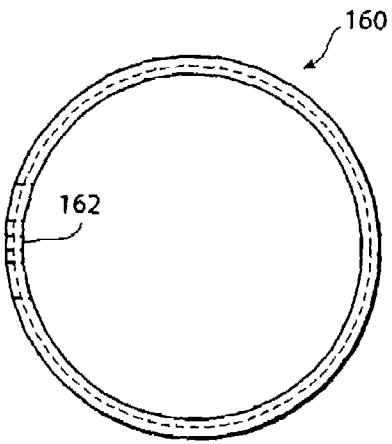
Figure 22:
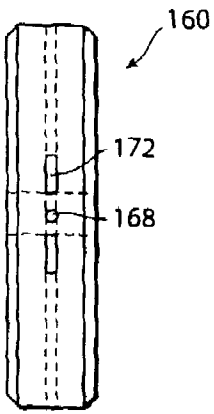
Figure 20:
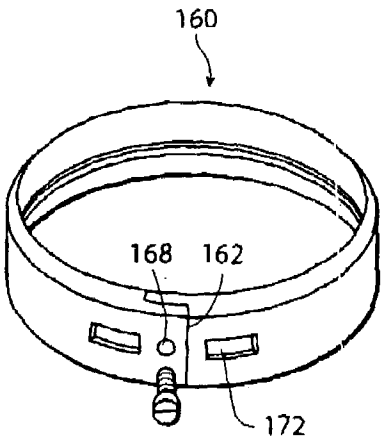
Figure 19:
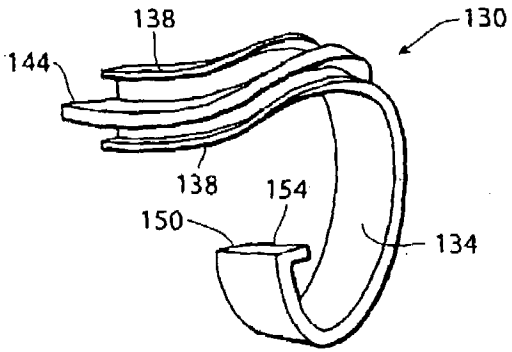
Figure 23:
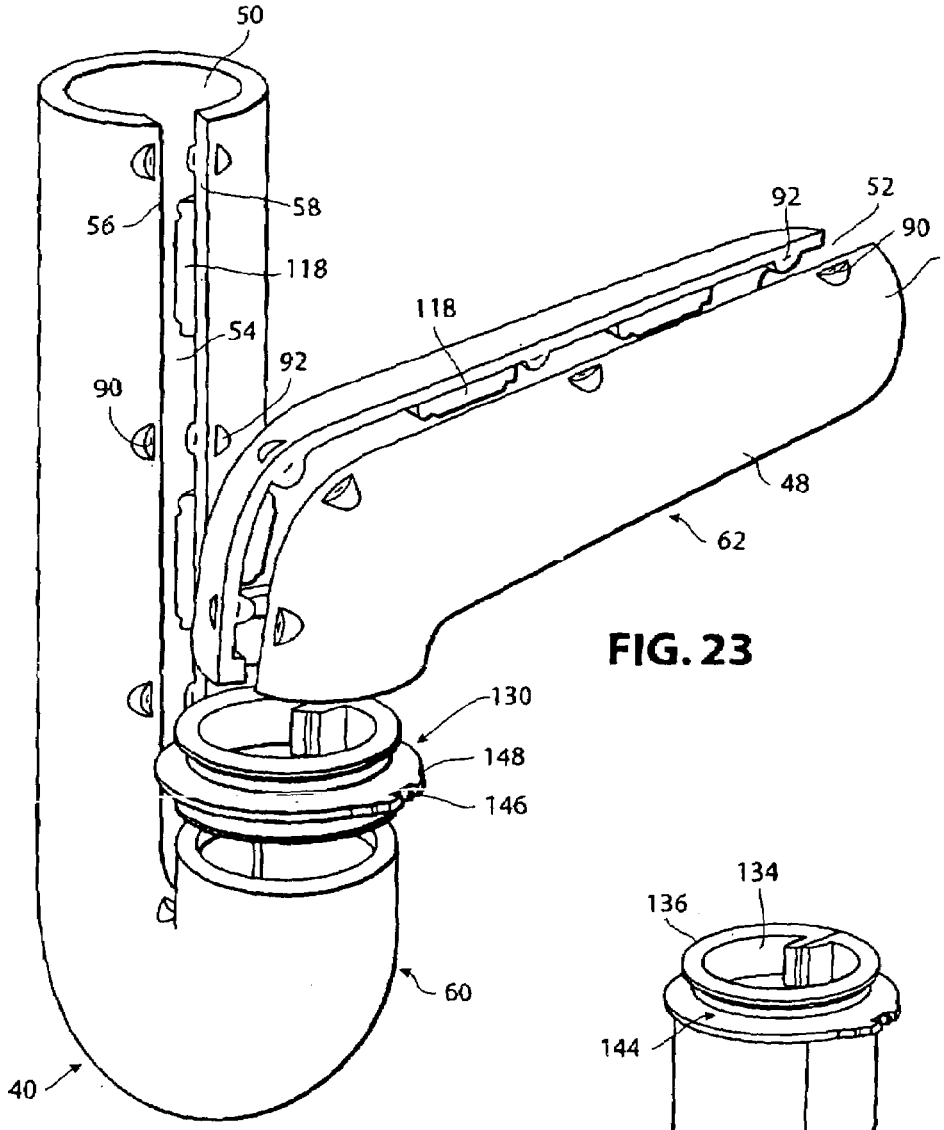
Figure 24:
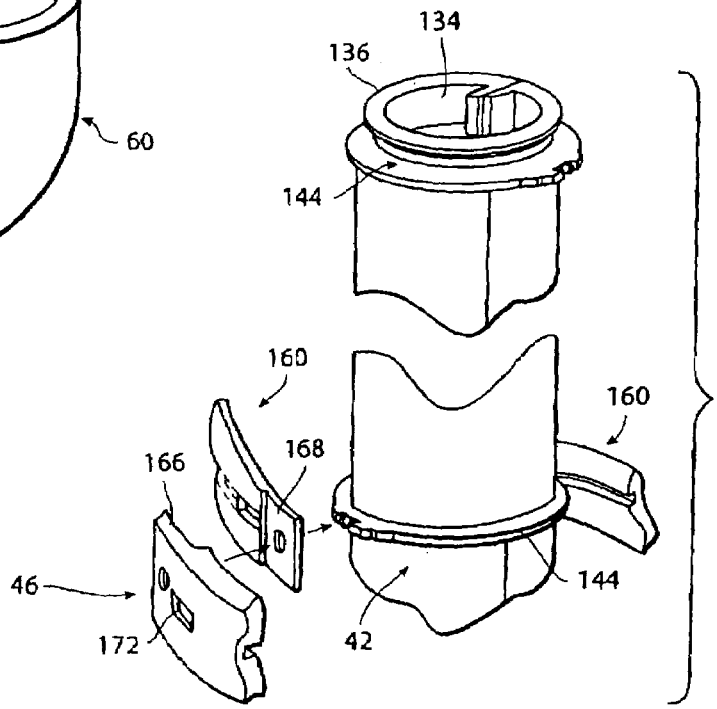
Figure 25:
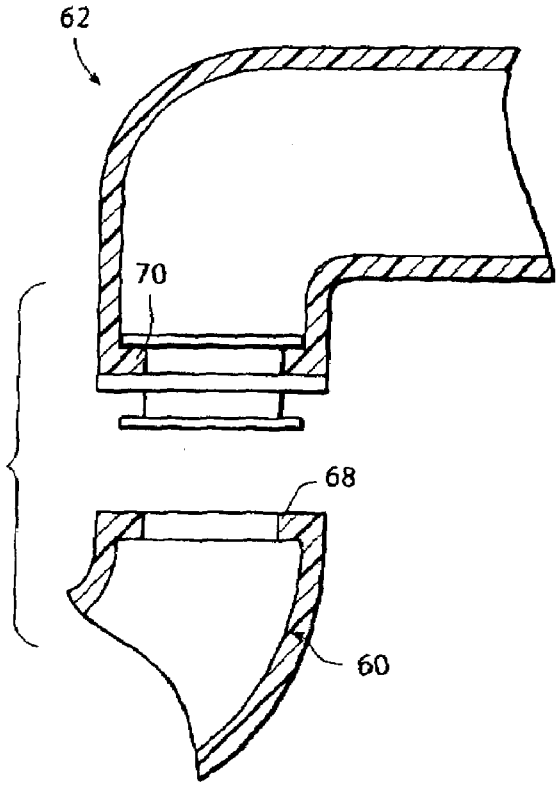
Figure 26:
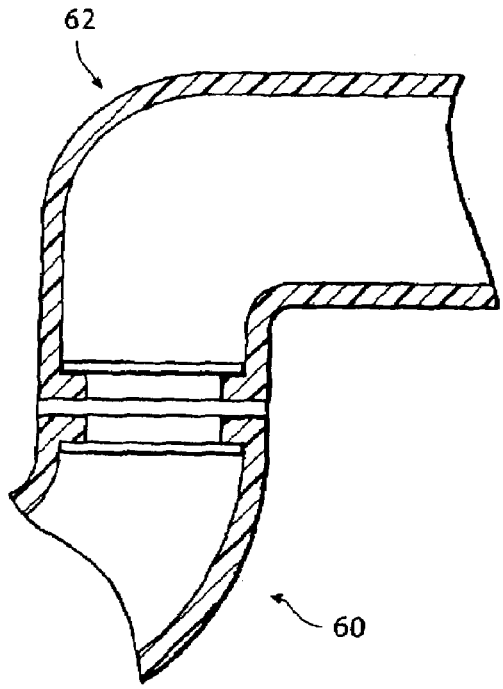
Figure 27:
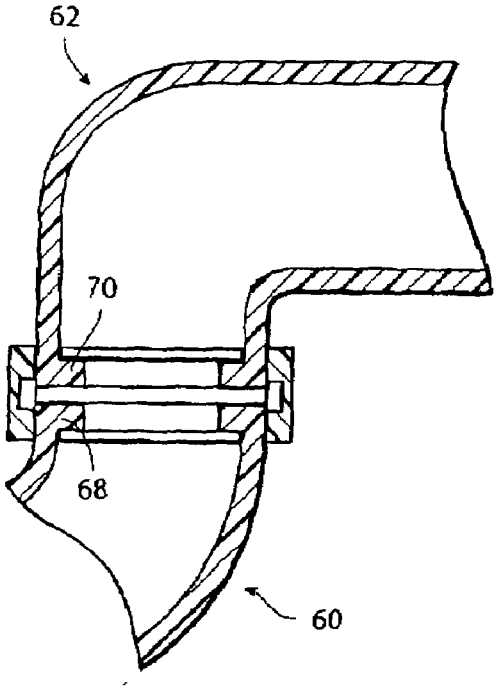
Figure 28:
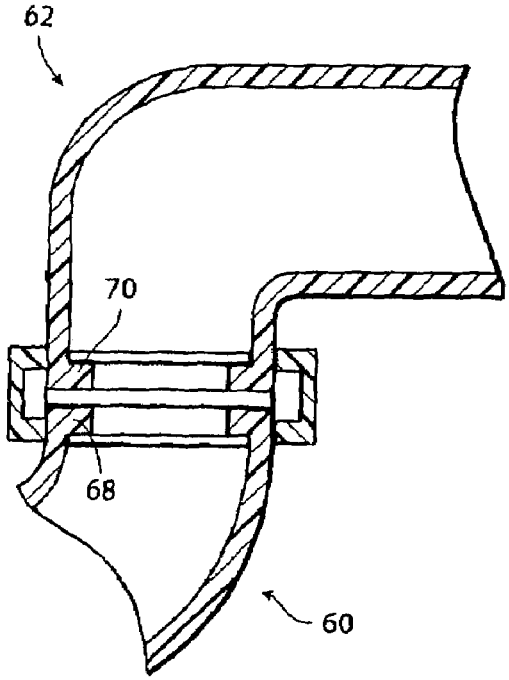
Figure 29:
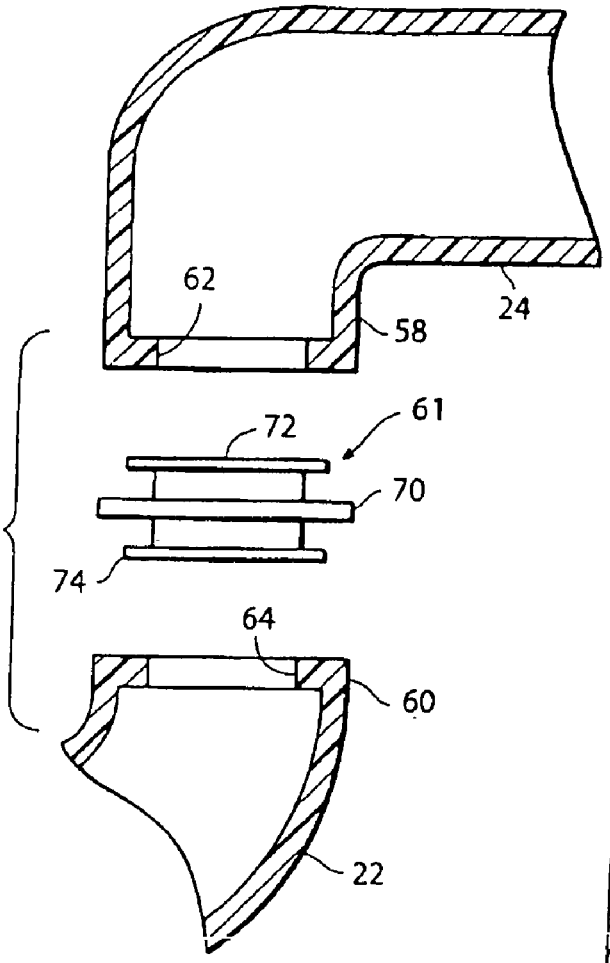
Figure 30:
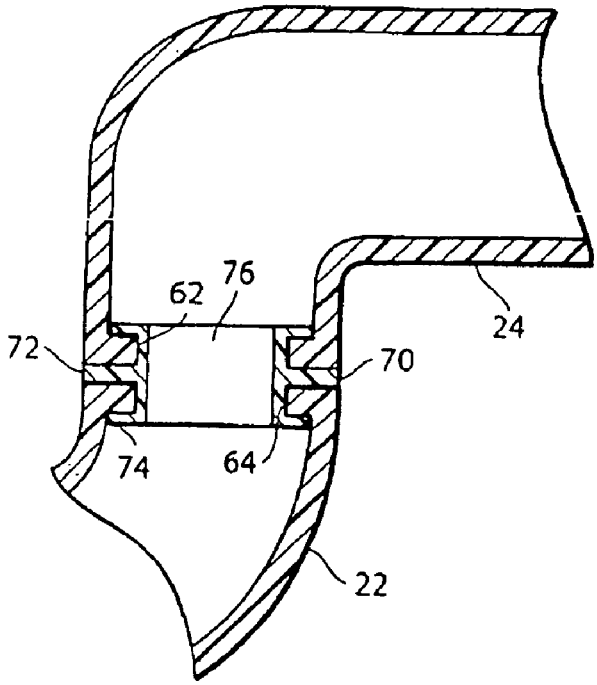

Having thus described the invention in general terms, reference will now be made to the accompanying drawings in which:

FIG. 1 is a somewhat schematic side elevational view, showing a conventional sink and drain pipe arrangement used therewith;

FIG. 2 is a fragmentary side elevational view of a prior art form of heat protective cover arrangement, used with an undersink P-trap assembly;

FIG. 3 is a perspective view of a pipe protective cover, in accordance with the present invention;

FIG. 4 is a perspective view of a pipe protective cover, similar to FIG. 3, and showing a waste arm cover portion thereof at an angle with respect to the plane of the J-trap cover forming a part thereof;

FIG. 5 is a vertical sectional view taken substantially along the plane of line 5—5 of FIG. 3;

FIG. 5A is a fragmentary sectional view of opposed ends of a J-trap cover section and a waste arm cover and showing locking flanges on the ends thereof;

FIG. 6 is a horizontal sectional view, taken substantially along line 6—6 of FIG. 3;

FIG. 7 is a fragmentary front elevational view of a portion of the jacket of FIG. 3, and taken substantially along the plane of line 7—7 of FIG. 4;

FIG. 8 is an enlarged sectional view taken along line 8-8 of FIG. 7, and showing one of the lock housings in one of the edges of the cover of FIG. 4;

FIG. 9 is a fragmentary perspective view, showing an interior portion of the pipe cover of the present invention, and the releasable fastening arrangement used for securing portions thereof together, along with a longitudinal slit;

FIG. 10 is a side elevational view of one of the locking pins, which can be used with the jacket of the present invention for extending between pairs of apertures at the elongate slit;

FIG. 11 is a fragmentary perspective view showing the mounting means for a quick fastener attachment at the edge of the elongate slit, in the cover of the present invention;

FIG. 12 is a horizontal sectional view taken through a modified form of the protective cover of the invention, and showing a slightly modified form of rib arrangement on the interior thereof;

FIG. 13 is a horizontal sectional view, substantially similar to FIG. 12, and showing the protective cover of FIG. 12 with a pipe covered thereby;

FIG. 14 is a horizontal sectional view, similar to FIGS. 12 and 13, and showing the protective cover around a slightly larger diameter pipe;

FIG. 14A is a sectional view, substantially similar to FIGS. 12–14, and showing a jacket which is slightly elliptically shaped, in accordance with the present invention;

FIG. 15 is a perspective view of a coupling ring used in accordance with the present invention, for securing abutting edges of two pieces of the cover, in accordance with the present invention;

FIG. 16 is a top plan view of a coupling ring of FIG. 15;

FIG. 17 is a side elevational view of the coupling ring of FIG. 15;

FIG. 18 is a perspective view of the coupling ring of FIG. 15, when twisted to show details thereof;

FIG. 19 is a perspective view of an outer locking band, used with the coupling ring of FIGS. 15 through 18;

FIG. 20 is a side elevational view of the locking band of FIG. 19;

FIG. 21 is a top plan view of the locking band of FIG. 19;

FIG. 22 is a perspective view of the locking band of FIG. 19 in a twisted arrangement to show details thereof;

FIG. 23 is an exploded perspective view, showing the use of the locking ring assembly of FIGS. 15 through 22, for securing two pieces of a protective cover together, when a waste arm is located at an acute angle with respect to the plane of the J-trap;

FIG. 24 is a fragmentary exploded perspective view, showing the relationship of the components of FIGS. 15 through 22 when securing two jacket sections together, as shown in FIG. 23;

FIG. 25 is an exploded fragmentary sectional view, showing the arrangement of the coupling ring assembly, and two sections of a pipe cover, which are to be secured together;

FIG. 26 is a fragmentary sectional view, similar to FIG. 25, and showing a partial assembly thereof;

FIG. 26A is an enlarged fragmentary sectional view, similar to FIG. 5A, and showing two jacket sections secured with a locking ring disposed thereabout;

FIG. 27 is a fragmentary sectional view, similar to FIG. 26, and showing a further stage in the assembly of the components of FIGS. 15 through 22;

FIG. 28 is a fragmentary sectional view, similar to FIGS. 25 through 27, and showing a completed assembly of the components of FIGS. 15 through 22, about two cover sections;

FIG. 29 is an exploded fragmentary vertical sectional view showing a modified means for using the coupling ring assembly for securing to sections of a protective cover, in accordance with the present invention; and FIG. 30 is a fragmentary sectional view, similar to FIG. 29, and showing the completed modified assembly of FIG. 29.

DETAILED DESCRIPTION OF PREFERRED EMBODIMENTS

Referring now in more detail and by reference characters to the drawings, reference will first be made to FIG. 1, which shows a conventional sink structure and the undersink pipe configuration normally used therewith.

The conventional sink structure comprises a sink 10 having a basin 12, which is capable of allowing water to drain through a J-trap 14, having a pair of vertically spaced apart legs 15 connected by a U-shaped bend 16. Also connected to the J-trap is a somewhat L-shaped waste arm 18, leading to a drain pipe 20, the latter of which is located within a wall structure, in the manner as shown in FIG. 1. A nut 22 is provided for securing the waste arm 18 to the J-trap 14.

In most cases, the waste arm 18 only is connected in that it is essentially within the same plane as the pipes forming part of the J-trap 14. However, in some cases, depending upon the pipe configuration and space requirements, the waste arm 18 may be angularly located to the plane of the J-trap 14.

It can be observed in connection with the present invention, that an unambulatory party in a wheelchair could easily and readily roll his or her knees and legs into contact with the J-trap. In this case, and particularly if the party in the wheelchair has lesser sensitivity in their legs, and if hot water has passed through the J-trap, they could burn their knee or leg, or both. In addition to the foregoing, the undersink piping is almost inevitably made of metal and usually comprised of one or more pipe nuts 22, as shown in FIG. 1. Consequently, risk of abrasion also arises.

Recently, the United States Government has mandated protective covers for undersink pipes in certain building structures, and particularly, under the Americans With Disabilities Act ("ADA"). Consequently, there is a need for a convenient and easy to use undersink pipe cover arrangement, which can be disposed about undersink pipes.

FIG. 2 illustrates one prior art undersink pipe cover arrangement, which is comprised of a J-shaped pipe cover 26 and an L-shaped waste arm cover 28. In the arrangement as shown, the waste arm 18 extends to a wall structure 30. On the opposite side of that wall structure, there would normally be a drain pipe (not shown).

The upper end of the J-trap is connected to the underside of the basin 12, also in the manner as shown in FIG. 1. In this way, waste water will drain through the J-trap and down through the drain pipe (not shown in FIG. 2). It can be seen that the cover 26 is also U-shaped and comprised of a pair of vertical arms connected by a U-shaped member 34. Moreover, the waste arm pipe is connected to the J-trap by means of a locking nut 37. In that region, there is provided a coupling arrangement 29 between the two pipe covers. Thus, the waste arm has a diametrally enlarged flange 38, which engages the upper end of the J-trap.

In the embodiment of the prior art cover arrangement, as shown in FIG. 2, one of the cover sections, such as the L-shaped cover section, is shown as having a plurality of inwardly projecting ribs 36, for engagement with the waste arm extending therethrough.

The conventional pipe cover arrangement illustrated in FIG. 2 is exemplary of various types of prior art pipe covers. In this case, the pipe cover arrangement is time consuming and difficult to install, and did not always properly fit the pipes. It can be observed that the pipe covers or jackets had an elongate slit, and the jackets were formed of resilient material, so they could be spread apart at the elongate slit and fitted upon the pipe configuration having the same arrangement. It was then necessary to engage in time consuming connection of spaced apart apertures along both sides of the elongate slit.

FIG. 3 illustrates one form of pipe cover, or so-called "jacket" 40, in accordance with the present invention. In this case, the jacket 40 is comprised a pair of vertical legs 42 and 44, which were connected by a U-shaped section 46. The leg 44 integrally merges into an outwardly arranged horizontally extending leg 48. In this way, the jacket formed both the configuration of a J-trap and integrally formed J-trap cover, and an integrally formed waste arm cover. The jacket, as shown in FIGS. 3 and 4, in one embodiment could be circular in cross-section, and is provided with an upper open end 50 and an open outer end 52, which would generally abut against a wall structure. In this way, if the waste arm was shorter than that shown in FIG. 3, a portion of the jacket, namely, the horizontal leg 48, could be cut in order to provide a proper length of cover.

The jacket is also provided with a longitudinal slit 54, also extending from end to end. The jacket is preferably formed of an injection molded plastic, so that it has some resiliency, enabling the jacket to be spread apart along the elongate slit and spread around a pipe configuration of same shape. The material forming the jacket is sufficiently resilient so that it will then return to its unopened position, substantially as shown in FIG. 3.

The jacket is preferably formed in an injection molding operation, and may be formed of polyvinylchloride, or any of a variety or other known plastic materials. For this purpose, various acrylic resins could also be used.

The elongate slit 54 essentially forms a pair of abutting edges 56 and 58, which are capable of abutting against one another when the jacket is allowed to resiliently return to its un-spread apart condition. These two abutting edges are then provided with locking means, as hereinafter described. Any material which provides sufficient resiliency to allow the horizontal extending leg 48 to be bent, such as shown in FIG. 4, can be used for this purpose. Moreover, the material forming the jacket must have sufficient elasticity so as to return to its original condition.

As indicated previously, and in the vast majority of cases, the waste arm 18 will lie substantially in the same plane as the J-trap 14. However, there are some situations in which the waste arm 18 is bent at a relatively acute angle with respect to the plane of the J-trap. In cases where the angle is not too acute, the horizontal leg 48 can be bent, substantially as shown in FIG. 4. Thus, the jacket does allow for fitting about a pipe configuration where the waste arm does not lie in the same plane as the J-trap. Thus, the horizontal arm 48 can be bent at an angle of approximately up to about 40° in either direction, and still comfortably and properly fit about the undersink pipe configuration. However, beyond that point, the jacket becomes somewhat unsightly, and does not necessarily present the smooth tailored configuration, as when the waste arm is in the same plane as the J-trap.

In the case where the angle may exceed this sharp acute angle, for example, 40° or more, the jacket 40 of the invention can be split into a pair of jacket sections. By reference to FIG. 5, it can be seen that there is a pre-cut region 58, which divides the jacket or pipe cover into a first J-shaped pipe cover, or J-trap pipe cover 60, and a waste arm pipe cover 62. The molded pre-cut 58 is more fully illustrated in FIG. 5 of the drawings. It can be seen, in the enlarged detailed view of FIG. 5A, that there is an inwardly annularly extending ridge 64, containing a scored area 66. In this way, severing of the single unitary jacket into a J-trap jacket cover 60 and a waste arm jacket cover 62, can easily be accomplished. It is to be noted that the score line is not that deep, such that one could not easily pull the jacket apart. However, by a substantial amount of force, the unitary jacket could be pulled apart into two sections at the score-line 66.

It can be observed, by reference to FIG. 5A, that when the unitary jacket 40 is severed into a J-trap cover 60 and a waste arm cover 62, that there is an upwardly located inwardly extending annular flange 68, at the upper end of the J-trap cover, and an inwardly extending annular flange 70, at the lower end of the vertical portion of the waste arm cover 62. These flanges could be sealed together by a suitable adhesive, or the like. However, in a preferred embodiment of the invention, a coupling assembly is used, as hereinafter described in more detail.

In the embodiment of the jacket 40, as shown in FIGS. 3–5, there are provided a plurality of inwardly projecting ribs 72, along the length of the entire jacket. These ribs essentially extend longitudinally throughout the jacket, and are interrupted by spaces 74. The ribs 72 are somewhat trapezoidally shaped, and project inwardly into the jacket. Also, there is provided a second set of ribs 76, which are essentially located between certain of the ribs 72, in the manner as best shown in FIG. 5. In accordance with the rib arrangement as shown, the jacket can be disposed about a larger diameter pipe and a smaller diameter pipe. With the larger diameter pipe, the ribs 72 will abut against the pipe, and in the smaller diameter pipes, the ribs 76 will abut against the pipe.

Both of the ribs 72 and 76, as shown in FIG. 5, have somewhat trapezoidal shapes. However, the longitudinal axis of the ribs 72 is aligned with the longitudinal axis of the jacket itself.

FIGS. 12, 13 and 14 also show different types of rib arrangements. In FIG. 12, there are rectangularly shaped ribs 78, which extend inwardly into the jacket for a relatively short distance, and longer ribs 80, which extend into the jacket for a greater radial dimension. By reference to FIG. 13, it can be seen that with a smaller diameter pipe 82, the larger diameter ribs 80 will abut against the pipe, as shown in FIG. 13. However, with a larger diameter pipe 84, as shown in FIG. 14, the shorter ribs 78, will abut against the pipe.

It is also possible to use an elliptically shaped jacket 86, as shown in FIG. 14A. In this way, it is possible to use the jacket or pipe cover about larger diameter pipes, without destroying the aesthetic appearance of the jacket. When a normal diameter pipe is employed, the jacket will adopt a slight elliptical shape, as shown in FIG. 14A, and with larger diameter pipes, there will be sufficient material to allow the jacket to fit about such pipes. However, the major and minor axis of the ellipse are such that the elliptical shape is not readily observable from any substantial distance. Nevertheless, it is effective to provide the ability to extend about two different sizes of pipes.

When the larger diameter pipe 84 is used, it can be observed that the larger ribs 80 will bend slightly angularly against the wall of the pipe, thus allowing the jacket to receive different diameters of pipe.

By reference to FIGS. 7 and 9, it can be observed that when the jacket is spread apart about the longitudinal slit 54, there will be provided pairs of aligned apertures 90 and 92. The aligned apertures 90 and 92, are sized to receive regular screws 94, having enlarged heads 96, as shown in FIG. 9. These apertures 90 and 92 are also sized to receive locking pins 98, substantially as shown in FIG. 10. Each of the apertures 90 and 92 lead into respective locking housings 100, substantially as best shown in FIGS. 6 and 8. These locking housings 100 have an internal shape substantially as shown in FIG. 8 of the drawings.

By reference to FIG. 8, it can be observed, for example, that one of the apertures of the pair 90, leads into a lock housing 100 with an elongate channel 102 having a pair of enlarged chambers 104 and 106. The chamber 106 leads into an inner opening 108. By further reference to FIG. 10, it can be seen that the locking pin 98 is provided with a shank 110 having a pair of enlarged ends 112. Each of the enlarged ends 112 are further provided with inwardly presented abutment shoulders 114. In accordance with this construction, it can be seen that the enlarged ends 112, and particularly, abutment shoulders 114 thereof, will be located in the chambers 104 and 106, and bear against ends thereof, so as to lockably hold the pin within the elongate channel 102.

The locking housings formed at each of these apertures 90 and 92, are thus receptive of set screws, such as the set screws as shown in FIG. 9, since the screws have threaded edges which will bear against the inner wall of the channel 102. In addition, and if desired, locking pins of the type as shown in FIG. 10, could also be used.

The jacket of the invention also provides for two different types of locking means to lock the edges 56 and 58 together, at the longitudinal slit 54. The second type of locking mechanism relies upon the use of either fiber fasteners, such as those fiber fasteners offered under the name "Velcro", or otherwise, the new so-called "Snap Lock Fasteners" offered by Minnesota Mining and Manufacturing. Since both types of fasteners use different locking mechanisms, they will be generically identified herein as "self gripping contact engageable fasteners" or "contact engageable fasteners". For purposes of holding the contact engageable fasteners, the edges 56 and 58 are each provided at the inner surfaces of the jacket with projections 118, having recesses 120, for receiving portions of the self gripping contact engageable fasteners 122, all as best shown in FIG. 11. These individual projections 118 are effective in holding individual pieces of the contact engageable fasteners. These fasteners can also be integrally formed with the jacket in the molding operation.

Inasmuch as there are a large number of contact engageable fasteners along the length of the elongate slit 54, they are effective in providing a fairly secure type of locking. However, if vandal proof type locking is required, then the set screw arrangement of FIG. 9, or the pin arrangement of FIG. 10, can be used. It can also be observed that cable ties could extend through the aligned apertures 90 and 92.

In one of the important facets of the present invention, it has been found that the contact engageable fastener can literally be molded into the product, as shown, during the molding stage of fabrication. Thus, the projection 118 can be integrally formed into the cover and the rapid engagement fasteners can be molded into the projection 118, all in a single stage operation. This will completely eliminate the time consuming and expensive hand operation of cutting individual pieces of fasteners and locating those fasteners in the holders therefor.

FIGS. 15 through 24 show a preferred form of releasably coupling of the J-trap cover 60 and the waste arm cover 62 together, using a coupling assembly 130. This coupling assembly 130 is more fully illustrated in the assembled form in FIGS. 23 and 24, and the components thereof are shown in FIGS. 15 through 22.

The coupling assembly 130 is used to provide a secure and, essentially, tamper proof coupling between the J-trap cover 60 and the waste arm cover 62. This is quite important, inasmuch as there has been some legislation requiring a tamper proof connection between components, so that one may not insert their fingers to engage the pipe between the two components.

The coupling assembly 130 includes a coupling ring housing 132, which is comprised of a cylindrically shaped body 134, having a pair of outer diametrally enlarged rims 136 and 138, as best shown in FIGS. 15 through 18 of the drawings. The enlarged rims 136 and 138 are sized to engage the interiorly presented abutment surfaces 140 and 142, on each of the flanges 68 and 70, formed at the coupling edges of the two jackets 60 and 62. Thus, the flange 136 will engage the inwardly presented abutment surface 140 of the flange 70, and the rim 138 will abut against the inwardly presented abutment wall 142 of the flange 68. There is a larger diameter inner ring 144 which will engage the abutting edges of the J-trap cover 60 and the waste arm cover 62. In this way, there is a substantial coupling action between the two jackets.

The enlarged diameter ring 144 is also provided with a pair of notches 146, for engagement by the fingers or thumb of a user, or for that matter, by a tool. The notches are actually formed in a diametrally enlarged projection 148, for reasons which will presently more fully appear.

The locking ring is formed with a slit 150, extending from one end to the other, to thereby allow the ring to be bent, as for example, in the manner as shown in FIG. 18. In this way, the coupling ring can be spread apart at the slit 150, and disposed about the pipe extending through the enlarged diameter pipe receiving opening 152.

The coupling ring 130 could also be provided with a pair of inwardly projecting locking tabs 154, which extend into the enlarged opening 152. These locking tabs would have hooked ends to be capable of coupling together, so as to lockably hold the coupling ring 130 in place. The coupling assembly could be used as described, in the manner as best shown in FIGS. 29 and 30 of the drawings. As indicated, the outer diameter locking rings would bear against the inner flanges 68 and 70.

In this case, it can be seen by reference to FIG. 30 that the inner enlarged diameter ring 144, fits precisely between the two jackets. For this type of construction, it may not be necessary to use the enlarged projection 148 with the notches 146, as shown in FIG. 15, 16 and 17 of the drawings. Moreover, this combination provides a very smooth and attractive appearance.

In order to provide greater security, when the coupling ring is installed in place, it is possible to use an outer locking ring 160, as shown in FIGS. 19 through 22. The locking ring 160 is provided with a slit 162, extending from end to end, so that the ends of the ring may be spread apart, allowing the ring to fit over the region of joinder of the two jackets and the region of the coupling ring 130. The locking ring 160 is also circular in shape and provided with a slit 162, allowing the ring to be separated, in the manner as shown in FIG. 22, so that it may extend about the coupling ring 130, in the region of joinder of the two jackets 60 and 62. In addition, the locking ring may be provided with an inner recess 164 at one edge of the slit 162, and a flange 166 capable of overlying the recess 164, so that the two form a smooth fitting connection, in the manner as shown in FIG. 20.

The flange 166 and the recess 164, are both provided with matching apertures 168, for receiving a set screw, or the like. In this way, the set screw can extend through the locking ring, and for that matter, through the coupling ring, and particularly, the enlarged diameter middle ring 138.

The locking ring 160 also has an inner recess 170, which is sized and located to receive the center locking ring 144 of the coupling ring 130. Moreover, the matching ends of the locking ring 160 are provided with openings 172, sized and located to receive the projection 148 on the middle locking ring 144. In this way, the locking ring becomes locked to the coupling ring 130.

FIGS. 25 through 28 illustrate the various stages in which the J-trap cover and the waste arm cover are coupled to one another with the coupling assembly of the invention. In FIG. 25, it can be observed that one of the outer rims 136 is located in abutting engagement with the inner diameter flange 140. The middle locking ring 144 is located in abutting engagement with the lower end of the waste arm cover. In FIG. 26, it can be observed that the lower rim 138 is in abutting engagement with the abutting surface of the inner flange 142, so that the two covers are effectively locked together in an essentially tamper proof manner.

FIG. 27 shows the initial stage in which the locking ring is disposed about the assembly of FIGS. 25 and 26. FIG. 28 illustrates an embodiment in which a further outer enlarged diameter finishing ring can be disposed about the assembly for coupling the two covers together.

The protective pipe cover of the present invention provides numerous advantages which are not available in any of the prefabricated prior art covers. First of all, it can be installed without any extra steps on J-traps and waste arms of a pipe assembly, where the waste arm is not located at a sharp acute angle from the plane of the J-trap. Secondly, even if the waste arm is located at a sharp acute angle with respect to the plane of the J-trap, the cover can be severed in the manner as previously described, into two pieces, and which can then be immediately fitted together, either with the coupling arrangement or without the same. Thirdly, the cover of the present invention is extremely fast to install. It does not require the time consuming constraints imposed on almost all prior art covers. It can be quickly locked together along the longitudinal slit. The fasteners provide for almost complete locking, merely by bringing the two edges of the jacket together.

One of the important facets of the invention is that the cover, when installed, has an attractive appearance. It has a smooth outer appearance that does not have the discontinuous look of numerous prior art covers. Secondly, the cover is provided in such manner that it literally follows the shape of the undersink pipe configuration. It cannot be installed in an upside down condition, or any other erroneous position, as with one or more prior art protective covers. In addition, the coupling assembly makes the entire jacket arrangement almost completely vandal resistant. The smooth exterior surface design, or for that matter, the smooth interior surface design, also reduces grime and fungus build-up.

There are weep holes provided in the lower end of the U-shaped portion of the jacket, which allows for water drainage and ventilation. Hence, odor build-up is reduced and the possibility of fungus, rust, and the like, is reduced, since there is a provision for drainage.

Thus, there has been illustrated and described a unique and novel unitary pipe cover assembly for undersink pipes, and which thereby fulfills all of the objects and advantages which have been sought. It should be understood that many changes, modifications, variations and other uses and applications which will become apparent to those skilled in the art after considering the specification and the accompanying drawings. Therefore, any and all such changes, modifications, variations and other uses and applications which do not depart from the spirit and scope of the invention are deemed to be covered by the invention.

Having thus described the invention, what I desire to claim and secure by letters patent is:

1. A protective cover for disposition about the J-trap and waste arm of an undersink pipe configuration to conform to the general shape of the J-trap and the waste arm, said protective cover comprising:

a) a unitary jacket having a somewhat J-shape with a pair of vertical legs connected by an arcuate element extending between and connecting the J-trap and the waste arm of the pipe configuration;

b) a somewhat horizontally extending leg extending outwardly from one of the vertical legs of the unitary jacket and with an arcuate connecting region therebetween, said leg being sized to be disposed about the waste arm of a pipe configuration;

c) said cover being formed of a flexible and resilient material to allow said somewhat horizontally extending leg of said cover to be bent at said connecting region and at an angle relative to the plane of the J-trap and without any significant buckling at that connecting region; and d) means at said arcuate connecting region of said cover allowing said horizontally extending leg of said cover to be located at a relatively acute angle with respect to the plane of the remainder of the cover around the J-trap of the pipe configuration without any significant buckling in the arcuate connecting region.

2. The protective cover of claim 1 further characterized in that the means which allow said somewhat horizontally extending leg of the cover to be located at an angle is a score line formed in the arcuate connecting region.

3. The protective cover of claim 2 further characterized in that the means which allow said somewhat horizontally extending leg of said cover to be rotated at an angle relative to the plane of the J-trap cover further comprises a slightly greater cross-sectional thickness in the region of the arcuately shaped section.

4. The protective cover of claim 1 further characterized in that said generally horizontally extending leg of said cover can be rotated up to an angle of about 40° relative to the plane of the cover about the J-trap of the pipe configuration.

5. The protective cover of claim 1 further characterized in that said cover can be severed in the arcuately shaped region to form a J-trap cover section and a waste arm cover section, said J-trap cover section having an inwardly struck flange at the end which would face the waste arm cover section and said waste arm cover section having an inwardly struck flange at the end which would face said J-trap cover when disposed about a pipe configuration, and a locking member which engages the flange of the J-trap cover section and the flange of the waste arm cover section to releasably lock the two cover sections together.

6. The protective cover of claim 5 further characterized in that a locking ring extends about said waste arm cover section and said J-trap cover section and is releasably locked to said locking means.

7. A protective cover for an undersink pipe configuration to prevent contact by an individual with the pipe configuration, said cover comprising:

a) an elongate cover member having a pair of ends with open opposite ends;

b) a central pipe receiving channel extending between each of said open ends such that the cover can receive a pipe extending through said open ends;

c) an outer surface and an inner surface of said pipe cover member with said inner surface defining said central pipe receiving channel extending between the open ends;

d) a plurality of ribs projecting inwardly from said inner surface for a first radial dimension to engage the side wall of a first pipe forming part of a pipe configuration and having a first inner pipe diameter; and e) a second plurality of ribs also projecting inwardly from the inner surface of said pipe cover to engage the side wall of a second pipe forming part of the pipe configuration and having a larger diameter than that of the first pipe in the pipe arrangement;

f) whereby said jacket can snugly and properly fit about a first diameter pipe and also about a second diameter pipe without sacrificing tamper resistance and while still maintaining the aesthetic appearance of the pipe cover.

8. The cover for the undersink pipe configuration of claim 7 further characterized in that said plurality of first ribs extend longitudinally over the length of the pipe cover from one open end to the other open end thereof and with spaces between each of the ribs.

9. The cover for the undersink pipe configuration of claim 7 further characterized in that said ribs are generally stub-shaped with a top surface and outwardly tapering side walls thereof.

10. The cover for the undersink pipe configuration of claim 9 further characterized in that each of said ribs are generally trapezoidal in shape.

11. The cover for the undersink pipe configuration of claim 7 further characterized in that said ribs are constructed so that the first ribs can deflect when the cover is disposed about a second pipe forming part of the pipe configuration.

12. The cover for the undersink pipe configuration of claim 7 further characterized in that said first set of ribs have a different cross-sectional shape than said second set of ribs and are constructed so that they are capable of readily deflecting when the cover is disposed about the larger diameter pipe.

13. The cover for the undersink pipe configuration of claim 7 further characterized in that said cover is formed as a unitary member and has a shape which will generally extend over the J-trap of a pipe configuration and the waste arm of that pipe configuration.

14. A cover for an undersink pipe configuration effective to prevent contact by an individual with the pipe, said cover comprising:

a) a jacket formed of a material which is capable of being resiliently spread apart and located about an undersink pipe and having a pair of open ends thereon;

b) an elongate slit extending between each of said open ends to allow said cover to be spread apart and fitted about a pipe in an undersink pipe configuration and where opposite edges of said slit will resiliently close together;

c) fastener receiving retaining members located adjacent each of the opposite edges on each side of said elongate slit;

d) first contact engageable fasteners within said retainer members to provide a self gripping locking action on one side of said elongate slit; and e) second contact engageable fasteners within said retainer members on another side of said elongate slit which co-act with said first contact engageable fasteners to provide a self gripping locking action upon engagement of said first and second contact engageable fasteners.

15. The cover for an undersink pipe configuration of claim 14 further characterized in that said contact engageable fasteners are self gripping locking fasteners.

16. The cover for an undersink pipe configuration of claim 14 further characterized in that said contact engageable fasteners are fiber fastening members which lock with one another upon engagement.

17. The cover for an undersink pipe configuration of claim 14 further characterized in that said retaining members and the first contact engageable fasteners extend along one edge of said slit for almost the full length of said elongate slit and said retaining members and second contact engageable fasteners on the second side of said slit extend for almost the full length of said slit on the opposite side of said slit on the opposite side of said slit.

18. A coupling mechanism for coupling first and second pipe cover pieces together at ends thereof when disposed about a liquid carrying pipe configuration, said coupling mechanism comprising:

a) an inner coupling ring housing having a first body section for fitting into an open end of said first cover piece and a second axially arranged second body section for fitting into an open end of said second cover piece when said open ends are opposed to one another;

b) engagement means on said body sections to engage portions of the interior of each of said cover pieces in proximity to the opposed open ends thereof; and c) whereby said engagement means thereby releasably but tightly locks said cover pieces to one another at the opposed ends thereof and where the coupling ring housing body sections each have a contour generally the same as each of said cover pieces.

19. The coupling mechanism for coupling two pipe cover pieces together of claim 18 further characterized in that said engagement means comprises:

a) a first outwardly projecting flange at one end of said first body section and engaging a portion of the interior of said first cover piece; and b) a second outwardly projecting flange on an end of said second body section for engaging a portion of the interior of said second cover piece.

20. The coupling mechanism for coupling two pipe cover pieces together of claim 18 further characterized in that said ring housing has an outwardly extending annular locking ring located between said first and second body sections.

21. The coupling mechanism for coupling two pipe cover pieces together of claim 20 further characterized in that the locking ring has a peripheral size so that it is approximately the same as the peripheral size of the outer surfaces of the cover pieces.

22. The coupling mechanism for coupling two pipe cover pieces together of claim 18 further characterized in that said body sections and said cover pieces are generally circular in cross-sectional shape.

23. The coupling mechanism for coupling two pipe cover pieces together of claim 18 further characterized in that the engagement means comprises one of a groove on the interior of each of said cover pieces or the ring housing and a projecting flange on the other of the cover pieces or ring housing, such that the flange projects into and is engaged in said groove, and the ring housing fits into the open ends and an interior of each of said cover pieces.

24. An arrangement for coupling two pipe covers in releasable locking engagement about a pipe configuration comprised of at least one liquid carrying pipe, said arrangement comprising:

a) first pipe cover having an open end and a central pipe receiving channel extending through said first cover;

b) a second pipe cover having an open end and a central pipe receiving channel extending through said second cover;

c) inwardly struck flanges at the open ends of each of said pipe covers; and d) a coupling housing located within the open ends of each of said covers and having elements which engage each of said flanges in locking engagement to thereby releasably lock said pipe covers together at said open ends.

25. The arrangement for coupling two pipe covers in releasable locking engagement of claim 24 further characterized in that said elements which engage said flanges are ring elements at opposite ends of said coupling housing.

26. The arrangement for coupling two pipe covers in releasable locking engagement of claim 25 further characterized in that said ring elements engage said flanges of said first and second pipe covers on sides opposite to the open ends thereof.

27. The arrangement for coupling two pipe covers in releasable locking engagement of claim 24 further characterized in that said coupling housing comprises a generally cylindrically shaped body with opposite ends and a ring element at each of the opposite ends thereof, said ring elements being generally circularly shaped.

28. The arrangement for coupling two pipe covers in releasable locking engagement of claim 27 further characterized in that a center abutment ring is located intermediate said ring elements and extending between and abutting against opposed ends of said pipe covers.

29. The arrangement for coupling two pipe covers in releasable locking engagement of claim 26 further characterized in that an outer circularly shaped locking ring cooperates with said coupling housing and engages outer surfaces of the abutted pipe covers and locks with said coupling housing.

30. An undersink pipe cover adapted for disposition about an undersink protective pipe configuration having a J-trap and a waste arm connected thereto, said undersink pipe cover comprising:

a) a cover having a shape generally conforming to the shape of the undersink pipe configuration and with a pair of open ends thereon and an elongate channel extending from end to end;

b) an elongate slit extending between each of said open ends to allow said cover to be spread about the pipe configuration under a sink;

c) a region formed in said pipe which allows said pipe cover to be severed into a J-trap cover section and a waste arm cover section and which can be located in abutting engagement about an undersink pipe configuration;

d) an inwardly struck flange automatically formed in each of said pipe cover sections when said cover is severed into the individual pipe cover sections; and e) a coupling housing locatable within the open ends of each of said pipes and engageable with the flanges therein to releasably lock the two pipe cover sections together.

31. The pipe cover adapted for disposition about an undersink protective pipe configuration of claim 30 further characterized in that said coupling housing has an engagement ring at each of the opposite ends thereof which engages a side of the flange away from the open end of the pipe for each of said pipe cover sections.

32. The pipe cover adapted for disposition about an undersink protective pipe configuration of claim 31 further characterized in that said coupling housing also has an intermediate ring which extends outwardly and abuts the edges of the opposed open ends of each of the pipe cover sections and which ring has an outer surface generally contiguous with the outer surface of the cover.

33. The pipe cover adapted for disposition about an undersink protective pipe configuration of claim 30 further characterized in that said coupling housing has a generally cylindrically shaped body with opposite ends and a retaining ring element at each of the opposite ends thereof and which ring elements are each generally circularly shaped.

34. The pipe cover adapted for disposition about an undersink protective pipe configuration of claim 33 further characterized in that an outer cylindrically shaped locking ring cooperates with said coupling housing and engages the outer surface of the intermediate ring and locks therewith.

35. An undersink pipe cover adapted for disposition about an undersink protective pipe configuration having a J-trap and a waste arm connected thereto, said undersink pipe cover comprising:

a) a cover having a shape generally conforming to the shape of the undersink pipe configuration and with a pair of open ends thereon and an elongate pipe receiving channel extending from end to end;

b) an elongate slit extending between each of said open ends to allow said cover to be spread about the pipe configuration under a sink;

c) a region formed in said pipe which allows said pipe cover to be severed into a J-trap cover section and a waste arm cover section and which can be located in abutting engagement about an undersink pipe configuration;

d) an inwardly struck flange automatically formed in each of said pipe cover sections when said cover is severed into the individual pipe cover sections; and e) a coupling housing locatable within the open and of said J-trap cover section and the opposed open end of the waste-arm cover section, said housing being engageable with flanges on the inner surface of said cover sections to releasably lock the two pipe cover sections together in locking engagement at the open ends thereof.

* * * * *